US007735566B2

(12) United States Patent
Jones

(10) Patent No.: US 7,735,566 B2
(45) Date of Patent: Jun. 15, 2010

(54) ONE TRIP COMPLETION SYSTEM

(75) Inventor: Kevin R. Jones, Windlesham (GB)

(73) Assignee: Baker Hughes Incorporated, Houston, TX (US)

( * ) Notice: Subject to any disclaimer, the term of this patent is extended or adjusted under 35 U.S.C. 154(b) by 366 days.

(21) Appl. No.: 11/076,387

(22) Filed: Mar. 9, 2005

(65) Prior Publication Data

US 2005/0217847 A1 Oct. 6, 2005

Related U.S. Application Data

(60) Provisional application No. 60/559,889, filed on Apr. 6, 2004.

(51) Int. Cl.
*E21B 19/16* (2006.01)

(52) U.S. Cl. ..... 166/384; 166/305.1; 166/369; 166/382

(58) Field of Classification Search ..... None
See application file for complete search history.

(56) References Cited

U.S. PATENT DOCUMENTS

| | | | | |
|---|---|---|---|---|
| 6,854,522 | B2 * | 2/2005 | Brezinski et al. | 166/387 |
| 2003/0037931 | A1 | 2/2003 | Coon | |
| 2003/0106688 | A1 | 6/2003 | Saugier | |
| 2003/0196820 | A1 | 10/2003 | Patel | |
| 2003/0221829 | A1 | 12/2003 | Patel et al. | |

FOREIGN PATENT DOCUMENTS

| | | | |
|---|---|---|---|
| GB | 2370301 | A | 12/2001 |
| GB | 2381811 | A | 10/2002 |
| WO | WO 03/069115 | A2 | 8/2003 |

* cited by examiner

*Primary Examiner*—Zakiya W. Bates
(74) *Attorney, Agent, or Firm*—Steve Rosenblatt

(57) ABSTRACT

A completion involving expandable tools and/or tubulars involves running the assembly downhole in a single trip. The expansion can take place using a swage or inflatable or other expansion techniques. The assembly can be delivered on production tubing so that upon conclusion of the expansion and the setting of any hangers and barriers production or injection can proceed from a pre-selected zone or zones.

15 Claims, 1 Drawing Sheet

ONE TRIP COMPLETION SYSTEM

PRIORITY INFORMATION

This application claims the benefit of U.S. Provisional Application No. 60/559,889, filed on Apr. 6, 2004.

FIELD OF THE INVENTION

The field of this invention is completions that involve expansion downhole where the completion can be accomplished in a single trip.

BACKGROUND OF THE INVENTION

Intelligent well completions involve various elements for remote downhole flow control and monitoring. Typically oil, gas and/or water production is monitored and controlled. A completion assembly can also include other components such as screens, packers, liner hangers and blank pipe. A more recent development has been to use expansion technology to expand screens, packers, hangers and other downhole equipment. The expandable completion equipment can be used in open hole, cased and perforated holes or holes with perforated or slotted liners, to name a few examples. Typically the expandable downhole components were run in to the hole on drill pipe along with an anchor and a stroker device to sequentially drive a swage through the tools to be expanded. Even using expansion technology, the completion that then occurred was done in a separate trip. The prior procedure was to run in with the tools to be expanded and position them downhole. When placed into position the tools would be expanded, such as by driving a swage through them. The running string, typically drill pipe, would be pulled out of the hole (POOH) and a second trip on production tubing would follow with the remainder of the completion products. A tubing hanger would then be set and then packers would be set prior to the start of production.

The present invention addresses a one-trip solution to a completion that involves expansion so that the expansion device and the tools to be expanded as well as other tools that are needed for the completion can be delivered at one time. The expansion would take place and the remaining completion equipment set to allow production to then commence.

Others have combined drilling a wellbore on a composite coiled tubing string while transporting expandable casing. After the well is drilled, the bit is dropped and the casing is expanded with an inflatable. This method is illustrated in U.S. 2003/0106688 A1. Another method, shown in U.S. 2003/0221829 A1, delivers a lower and upper completion assembly is connected together and run in the well in a single trip. Thereafter a screen expander is run through tubing on a work string. It could have a shifting tool at its lower end to operate a valve before the expansion starts. Yet others deliver the completion assembly and an inflatable for expansion in two trips, as shown in U.S. 2003/0196820 A1. These techniques stop short of delivery of a completion system along with the expansion assembly in a single trip to allow the completion and expansion operations to take place with a single run. Those skilled in the art will more readily appreciate the scope of the present invention from the claims that appear below as further explained by a discussion of the preferred embodiment including the drawings.

SUMMARY OF THE INVENTION

A completion involving expandable tools and/or tubulars involves running the assembly downhole in a single trip. The expansion can take place using a swage or inflatable or other expansion techniques. The assembly can be delivered on production tubing so that upon conclusion of the expansion and the setting of any hangers and barriers production or injection can proceed from a pre-selected zone or zones.

DETAILED DESCRIPTION OF THE PREFERRED EMBODIMENT

Figure 1:
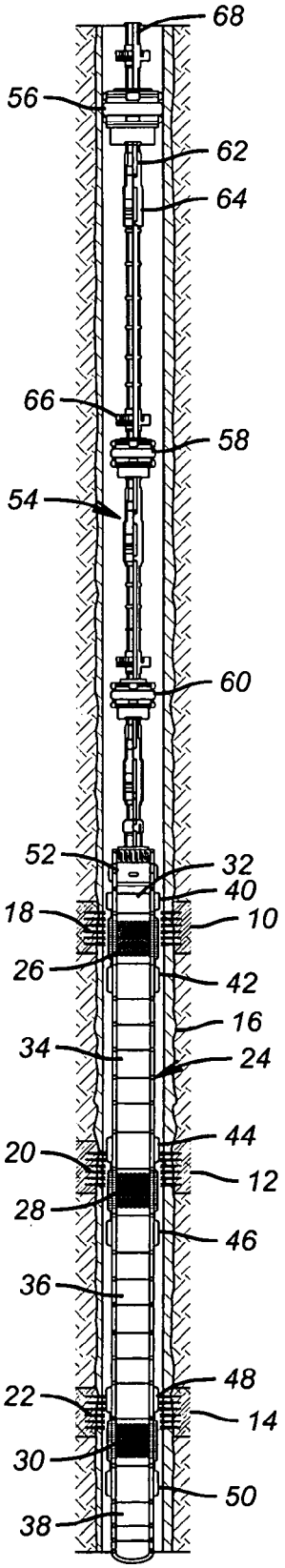
FIG. 1 shows the one trip completion assembly in the run in position.

Referring to FIG. 1, a preferred embodiment of the one trip completion system is illustrated. In this specific example, there are three producing zones 10, 12 and 14 that are spaced apart. Casing 16 is perforated to create perforations 18, 20 and 22 adjacent zones 10, 12 and 14 respectively. The outer completion 24 comprises screens 26, 28 and 30 and blank pipe 32, 34, 36 and 38. Expandable packers 40 and 42 straddle screen 26 so as to isolate zone 10 after expansion. For a similar reason as to zones 12 and 14 respectively packers 44 and 46 straddle screen 28 and packers 48 and 50 straddle screen 30.

The expansion assembly 52 is shown schematically at the top of blank pipe 32. In the preferred embodiment it comprises a releasable anchor adjacent a stroker, which is connected to a swage. Through a series of repetitive steps the anchor is set and the stroker strokes the swage as it advances top to bottom through the outer completion 24. The swage can be fixed or of variable diameter. The expansion assembly can be in a variety of styles and can accomplish the desired expansion by mechanical force on a swage, inflatable technology or other equivalent techniques. The expansion can take place in either direction, although top to bottom simplifies the operation of the preferred embodiment. A bottom to top expansion can be done with a collapsible swage to allow the inner completion 54 to be advanced into position with respect to the outer completion 24 after expansion. With top to bottom expansion, the inner completion 54 is simply advanced into the outer completion 24 as the expansion assembly 52 is actuated to advance into and expand the outer completion 24. This position is shown in FIG. 2.

Figure 2:
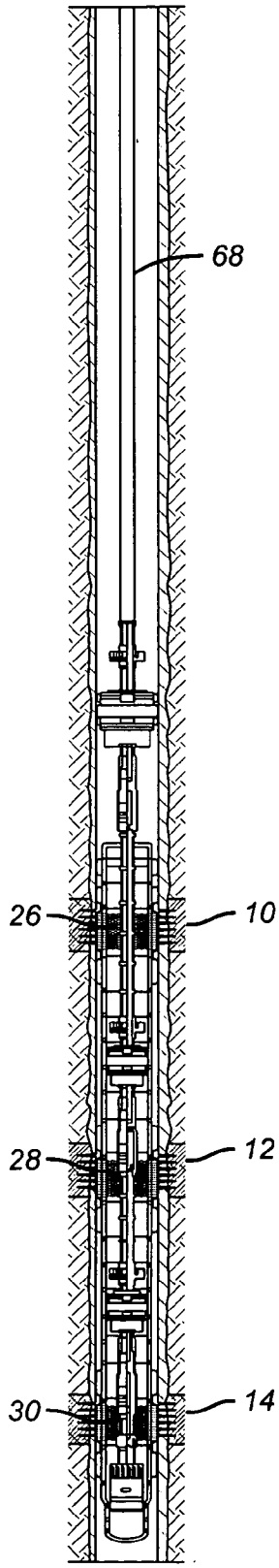
FIG. 2 is the view of FIG. 1 after expansion and with the balance of the completion assembly ready for the next downhole operation.

FIG. 2 shows that the outer completion 24 has been expanded. Zones 10, 12 and 14 have access to the interior of the outer completion 24 only through screens 26, 28 and 30 each of which has a pair of external packers straddling it and in a sealed position with the casing 16.

The inner completion 54 comprises packers 56, 58 and 60 that are spaced properly so that when the position of FIG. 2 is achieved, the screens 26, 28 and 30 are isolated from each other. Optionally, for intelligent completions, a sensor module 62 can be put adjacent one or more of the packers 56, 58 and 60. It can contain a variety of instruments, sensors and/or valves 64. Control lines, fiber optic cable or other power lines can go through the inner completion 54 to reach the various sensor modules 62 or valves 64. Valves 64 can be run in open to allow circulation and later selectively closed. Should any splices in cables or fiber optic lines be required a splice protector 66 can be used as needed. The valves 64 can be operated hydraulically, with locally mounted drives or with shifting tools subsequently delivered through the production tubing 68. Use of intelligent well completion components is optional.

Those skilled in the art will now appreciate that a complete completion system where part of the procedure is to expand can be delivered in a single trip and put into operating position for production, injection or the like. While the preferred embodiment has shown three zones and three screens other configurations are contemplated involving screens and expandable packers in the outer completion 24. The inner completion 54 can be configured in many other varieties than shown for the preferred embodiment. It can include hangers as well as packers and valves. The assembly can be run in open, cased or other types of wellbores such as those with slotted or perforated liners. The common denominator to the various available configurations is that the completion assembly is delivered in a single trip and put into operating position and that part of such set up is the use of expansion technology. Assisting in the effort is the ability to advance one part of the completion assembly with respect to another and preferably allowing this to occur as the expansion takes place. As previously stated, the expansion can occur in either direction or through use of inflatables or other techniques. If a wage is used it can be of fixed or variable diameter. Provisions can be made to drop the expansion assembly after expansion is completed. A variety of instruments and control devices can be integrated into the completion assembly to allow intelligent well management coupled with the cost and time savings of a single trip in the well to deliver and set in position a completion assembly that incorporates an expansion technique.

The foregoing disclosure and description of the invention are illustrative and explanatory thereof, and various changes in the size, shape and materials, as well as in the details of the illustrated construction, may be made without departing from the spirit of the invention.

I claim:

1. A completion method, comprising:

providing an outer tubular assembly with spaced apart openings to a plurality of zones in a subterranean location;

providing an inner tubular assembly having at least one flow port and at least one associated baffler to selectively isolate said flow port on the outside of said inner tubular assembly from a surface location;

providing an expansion device adjacent the lower end of said inner tubular assembly;

running in in a single trip said outer tubular assembly with said inner tubular assembly and said expansion device to a desired subterranean location for said outer tubular assembly;

expanding said outer tubular assembly with said expansion device moving with said inner tubular assembly relatively to said outer tubular assembly;

positioning said at least one flow port of said inner tubular assembly in fluid communication, through an annular space defined between said expanded outer tubular assembly and said inner tubular assembly, with at least one of said openings of said outer tubular assembly;

actuating said baffler in said annular space after expansion of said outer tubular assembly;

producing or injecting an adjacent formation in said single trip through said flow port in said inner tubular assembly and said opening.

2. The method of claim 1, comprising:

expanding said outer tubular assembly from top to bottom.

3. The method of claim 2, comprising:

advancing said inner tubular assembly into said outer tubular assembly during said expanding.

4. The method of claim 3, comprising:

releasing said expansion device from said inner tubular assembly after said expanding.

5. The method of claim 4, comprising:

retrieving said expansion device to the surface.

6. The method of claim 1, comprising:

expanding said outer tubular assembly from bottom to top.

7. The method of claim 6, comprising:

using a collapsible swage as said expansion device.

8. The method of claim 1, comprising:

isolating at least one subterranean zone with at least one external barrier on said outer tubular assembly;

producing or injecting said at least one zone through said inner tubular assembly.

9. The method of claim 8, comprising:

providing at least one screen in said outer tubular assembly;

straddling said screen with packers on said inner tubular assembly.

10. The method of claim 8, comprising:

providing at least one screen in said outer assembly;

straddling said screen with external packers on said outer tubular assembly.

11. The method of claim 8, comprising:

providing at least one of an instrument, a sensor and a valve in communication with said isolated zone.

12. The method of claim 8, comprising:

providing at least one of a control line and a fiber optic line to reach into said isolated zone.

13. The method of claim 1, comprising:

running said inner and outer tubular assemblies and said expansion device together into an open hole.

14. The method of claim 1, comprising:

running said inner and outer tubular assemblies and said expansion device together into a cased or lined hole.

15. The method of claim 1, comprising:

using one of a fixed diameter and a variable diameter swage as said expansion device.

* * * * *